US006674049B1

(12) United States Patent
Hughes

(10) Patent No.: US 6,674,049 B1
(45) Date of Patent: Jan. 6, 2004

(54) STORAGE DRUM HEATER

(76) Inventor: Harold H. Hughes, 390 Meadow Hill Rd., Fort Worth, TX (US) 76108-9225

( * ) Notice: Subject to any disclaimer, the term of this patent is extended or adjusted under 35 U.S.C. 154(b) by 69 days.

(21) Appl. No.: 10/114,571

(22) Filed: Apr. 2, 2002

Related U.S. Application Data

(60) Provisional application No. 60/281,456, filed on Apr. 4, 2001.

(51) Int. Cl.[7] ..... F24H 3/04

(52) U.S. Cl. ..... 219/400; 219/386; 392/360; 392/365

(58) Field of Search ..... 219/385, 386, 219/400; 392/360, 365, 367, 368, 373, 374, 379, 383

(56) References Cited

U.S. PATENT DOCUMENTS

| | | | | |
|---|---|---|---|---|
| 1,534,087 A | | 4/1925 | Sellew et al. | |
| 2,453,425 A | | 11/1948 | Freed | 219/19 |
| 2,471,964 A | | 5/1949 | Kisskalt | 22/87 |
| 2,662,965 A | | 12/1953 | Becker | 219/35 |
| 2,985,860 A | * | 5/1961 | Morey | 219/528 |
| 5,519,189 A | * | 5/1996 | Gibisch | 219/430 |

FOREIGN PATENT DOCUMENTS

| | | | |
|---|---|---|---|
| JP | 08-145297 | * | 6/1996 |

* cited by examiner

*Primary Examiner*—Joseph Pelham
(74) *Attorney, Agent, or Firm*—Bracewell & Patterson, L.L.P.

(57) ABSTRACT

A storage drum heater has an elongated housing and is typically used in a vertical orientation between storage drums arranged on a pallet. In one embodiment, the housing has closed ends and vertical sides that intersect four vertical, diagonal surfaces at their vertical edges. A column of holes is located in each diagonal surface, upper holes being axially spaced from lower holes. The housing contains a blower fan and a resistive heating element for heating air expelled by the blower. A battery is located in the housing and provides electrical power for operating the fan and the heating element. The fan draws air into the housing through the lower holes, then blows the air across the heating element and out of the housing through the upper holes, preferably into the V-shaped interstitial space between drums.

19 Claims, 2 Drawing Sheets

STORAGE DRUM HEATER

CROSS REFERENCE TO RELATED APPLICATIONS

Benefit is herein claimed of the filing date under 35 USC §119 and/or §120 and CFR 1.78 to U.S. Provisional Patent Application Serial No. 60/281,456, filed on Apr. 4, 2001, entitled "Storage Drum Heater."

BACKGROUND OF THE INVENTION

1. Field of the Invention

This invention generally relates to heating apparatus and particularly relates to a heating device for heating drums or other items arranged on a pallet.

2. Description of the Prior Art

It is often necessary to maintain the temperature of items stored in storage drums above a desired temperature. The drums may be exposed to excessively-cold temperatures on a loading dock, in a warehouse, or during transportation, requiring some form of barrier or temperature regulation.

For large storage drums, the drums are typically arranged in a square, four-drum pattern on a pallet. To protect the drums from excessively-cold temperatures, it is known to wrap one or more drums with a blanket or other material cover. These covers may also contain a resistive heating element for maintaining a minimum temperature. While these covers may be effective, they are bulky and, due to their exposed portions on the outside of the drums, may be damaged by contact with other items. Therefore, there is a need for a storage drum heater that is effective, convenient to use, and that is protected from damage during use.

SUMMARY OF THE INVENTION

A storage drum heater has an elongated housing and is typically used in a vertical orientation between storage drums arranged on a pallet. In one embodiment, the housing has closed ends and vertical sides that intersect four vertical, diagonal surfaces at their vertical edges. A column of holes is located in each diagonal surface, upper holes being axially spaced from lower holes. The housing contains a blower fan and a resistive heating element for heating air expelled by the blower. A battery is located in the housing and provides electrical power for operating the fan and the heating element. The fan draws air into the housing through the lower holes, then blows the air across the heating element and out of the housing through the upper holes, preferably into the V-shaped interstitial space between drums. Alternatively, the housing may have a circular lateral cross-section and may have as few as three columns of holes.

BRIEF DESCRIPTION OF THE DRAWINGS

The novel features believed to be characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings.

DETAILED DESCRIPTION OF THE INVENTION

FIGS. 1 through 7 show embodiments of a heater for maintaining the temperature of air surrounding storage drums above a desired minimum or for warming the drums. The storage drums are preferably carried on a pallet for loading and stacking.

Figure 1:
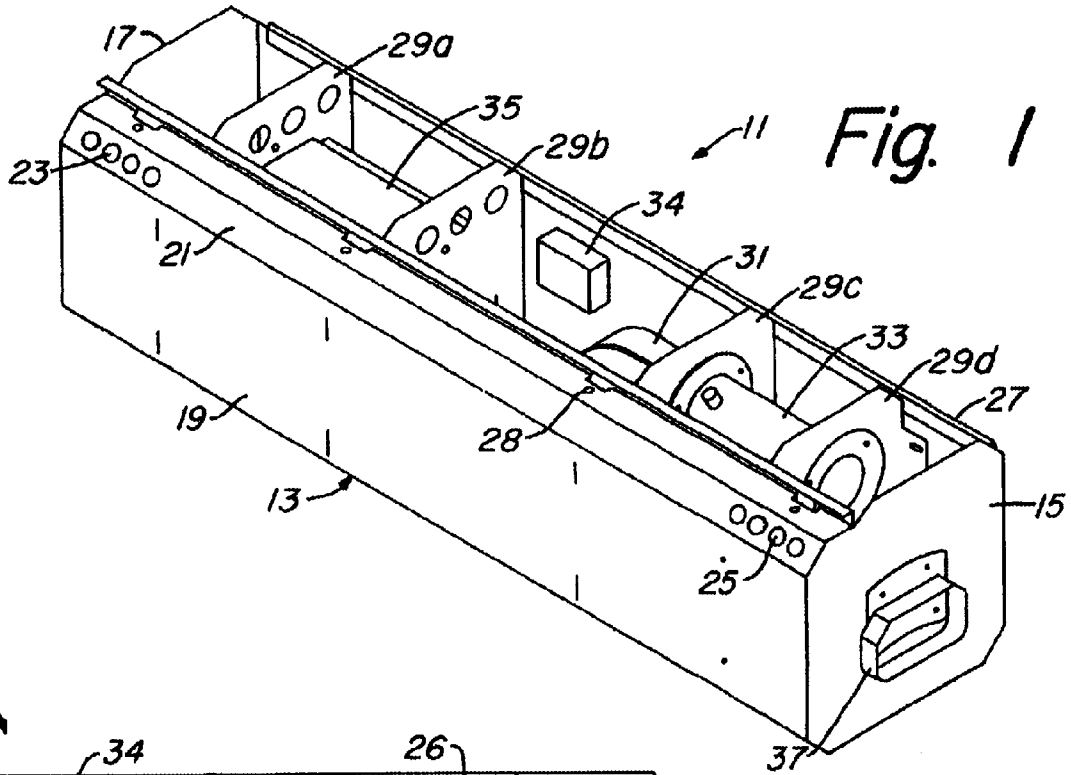
FIG. 1 is a perspective view of a storage drum heater constructed in accordance with the present invention.
Figure 2:
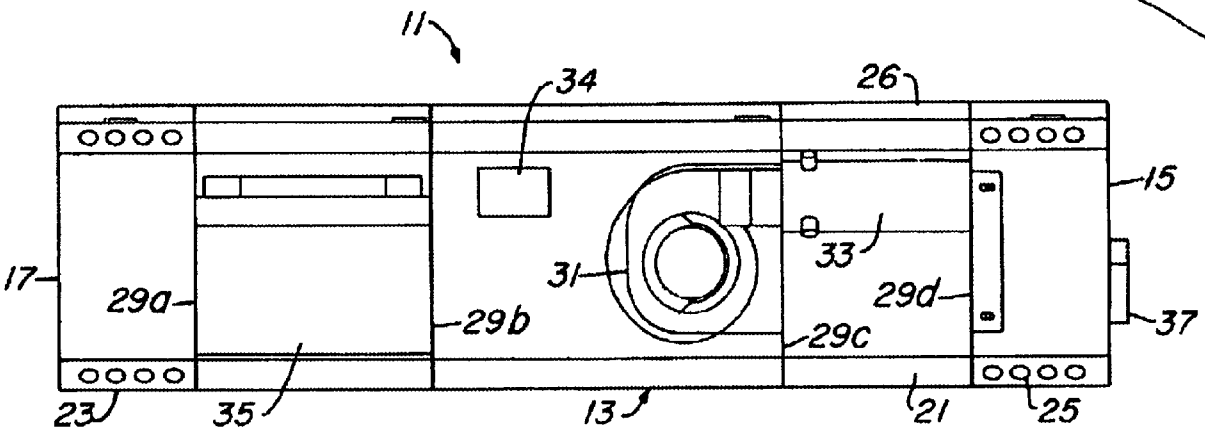
FIG. 2 is a side view of the heater of FIG. 1.

Referring to FIGS. 1 and 2, heater 11 comprises a steel or plastic rectangular housing 13 enclosing a system for heating and circulating air. Housing 13 is elongated along its height and has closed ends 15, 17. Three sides 19 of housing 13 each intersect diagonal surfaces 21 at their vertical edges. Diagonal surfaces 21 are located at the vertical corners of housing 13. Inlet holes 23 are located in a lower portion of each diagonal surface 21 and communicate with an intake plenum. Outlet holes 25 are located in a upper portion of each diagonal surface 21 and communicate with an exhaust plenum. Inlet holes 23 allow air to flow into housing 13, and outlet holes 25 allow air to flow out of housing 13. A fourth side 26 opens to allow access to the interior of housing 13. Hinged side 26 is attached to hinge 27 at one vertical edge of side 26. Fasteners (not shown) on hinged side 26 engage holes 28 in housing 13, allowing hinged side 26 to seal the volume within housing 13 when closed and fastened. Closing hinged side 26 causes air drawn through housing 13 to pass through holes 23, 25.

Four baffles 29*a*–29*d* are located within housing 13 and oriented to be perpendicular to the height of housing 13. Baffles 29 are partitions separating housing 13 into five compartments. The intake plenum is located between the lower end of housing 13 and baffle 29*a*. Holes in baffle 29*a* allow air to flow upward into a second compartment, which is located between baffles 29*a* and 29*b*, and holes in baffle 29*b* allow air to flow into a third compartment, which is between baffles 29*b* and 29*c*.

Fan 31 is mounted to the lower side of baffle 29*c* in the third compartment, fan 31 being operated to draw air through inlet holes 23 and through lower baffles 29*a* and 29*b*. Fan 31 is shown to be a squirrel-cage type, but may be of other types. Fan 31 discharges through baffle 29*c* into a heating unit 33. Heating unit 33 contains electric heating elements, which are preferably resistive wires. Heating unit 33 is located between the two upper baffles 29*c*, 29*d* and communicates with the outlet of fan 31 and the exhaust plenum, located in housing 13 between baffle 29*d* and the upper end of housing 13. Air enters fan 31 and is forced through heating unit 33 into the exhaust plenum, the heated air then exiting housing 13 through outlet holes 25. A control system 34 has a sensor that monitors the temperature outside of heater 11 and controls the operation of heater 11. A gel-cell battery 35 is located in the second compartment of heater 11 for providing power to control system 34, fan 31, and heating elements in heating unit 33. A handle 37 is provided on end 15 of housing 13 for lifting and supporting heater 11 during installation. Though shown located in particular locations, components of heater 11, such as control system 34 and battery 35 can be located in other locations, but are preferably within the interior of housing 13.

In operation, when the ambient temperature outside of heater 11 drops below a predetermined level, control system 34 directs power from battery 35 to heating unit 33 and fan 31. Fan 31 draws air into housing 13 through holes 23 and through baffles 29. The air is then blown through heating unit 33 and across the heating elements, the heated air exiting housing 13 through outlet holes 25 to be circulated near heater 11. When the ambient temperature has reached a selected level, control system 34 interrupts the power supplied to fan 31 and heating unit 33.

Figure 3:
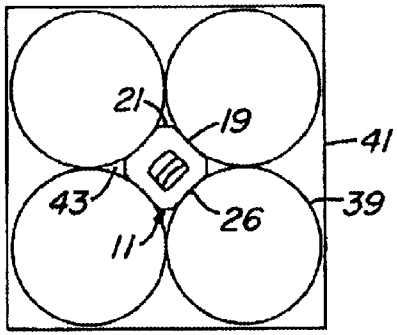
FIG. 3 is a top view of the heater of FIG. 1 installed on a pallet having four storage drums.

As shown in FIG. 3, four storage drums 39 are placed on a pallet 41 for transport. Heater 11 is placed in a vertical orientation in the space at the center of drums 39. Heater 11 is rotationally oriented so that sides 19, 26 of housing 13 touch drums 39, whereas diagonal surfaces 21 are located in V-shaped, interstitial spaces 43 between drums 39, allowing for air to flow into holes 23 (FIGS. 1 and 2) and out of holes 25 (FIGS. 1 and 2). When operating, the heated air from heater 11 assists in maintaining the temperature of air surrounding storage drums 39 above a desired minimum, the heat in the air being transferred to drums 39.

Figure 4:
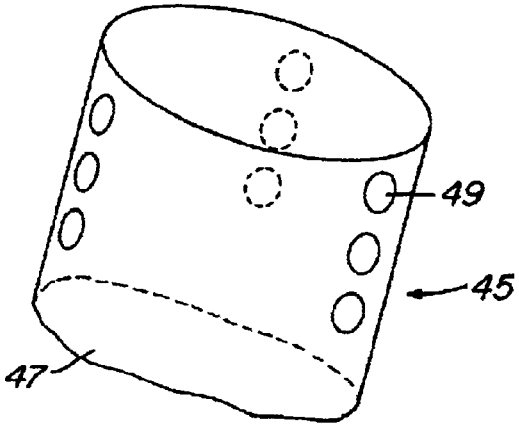
FIG. 4 is a perspective view of a an upper portion of a second embodiment of the present invention.
Figure 5:
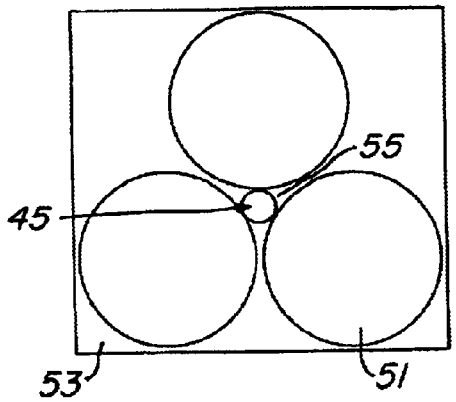
FIG. 5 is a top view of the heater of FIG. 7 installed on a pallet having three storage drums.

FIG. 4 shows an upper portion of a second embodiment of the present invention. Heater 45 is constructed to have the same internal components as heater 11, described above, but housing 47 has a circular lateral cross-section. Three columns of holes 49 are located in housing 47, holes also being located on a lower portion (not shown) of housing 47. An access panel (not shown) is provided in housing 47 for access to the interior of heater 45. FIG. 5 shows heater 45 installed in the space between drums 51 on pallet 53, the columns of holes 49 being oriented to allow heated air to flow from holes 49 into the V-shaped interstitial spaces 55 between drums 51.

Figure 6:
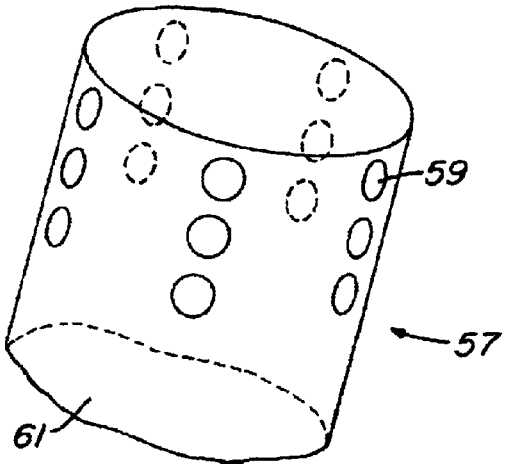
FIG. 6 is a perspective view of a an upper portion of a third embodiment of the present invention.
Figure 7:
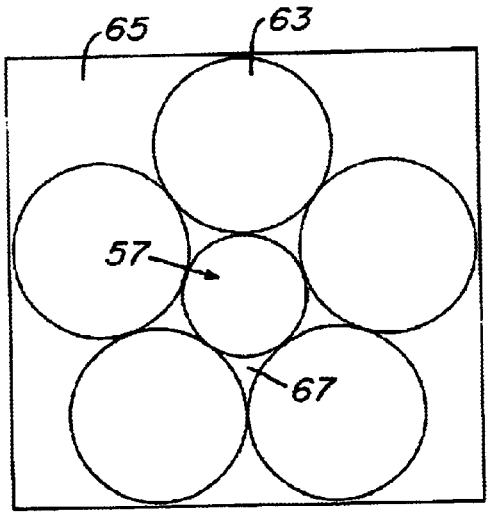
FIG. 7 is a top view of the heater of FIG. 6 installed on a pallet having five storage drums.

FIG. 6 shows an upper portion of a third embodiment of the present invention. Heater 57, like heater 45 (FIG. 4), has a circular lateral cross-section and the same internal components as heater 11 (FIG. 1). Five columns of holes 59 are located in the upper portion and lower portion (not shown) of housing 61. An access panel (not shown) is provided in housing 61 for access to the interior of heater 57. FIG. 7 shows heater 57 installed in the space between drums 63 on pallet 65, the columns of holes 59 being oriented to allow heated air to flow from holes 59 into the V-shaped interstitial spaces 67 between drums 63.

Several advantages are realized with the present invention. The heater is self-contained and is powered by a battery, eliminating the need for combustible liquids or gases. The heater is placed within the empty space between items on a pallet, protecting the heater from damage due to contact with surrounding items. The heater can be easily installed and removed for replacement or for recharging of the battery.

While the invention has been shown in only three of its forms, it is not thus limited but is susceptible to various changes and modifications without departing from the spirit thereof.

I claim:

1. A storage drum heater, comprising:

an elongated housing having closed ends, the housing having at least three columns of holes located in an exterior surface of the housing and communicating an interior and exterior of the housing, each column having at least one inlet hole and at least one outlet hole;

a blower fan located within the housing and oriented to draw air into the housing through the inlet holes and expel air from the housing through the outlet holes; and a heating element for heating the air prior to the air being expelled from the housing.

2. The heater of claim 1, wherein:

the inlet holes are located below the outlet holes.

3. The heater of claim 1, wherein:

the housing has three columns of holes angularly spaced 120° from each other, the holes in each column being in vertical alignment with each other.

4. The heater of claim 1, wherein:

the housing has four columns of holes angularly spaced 90° from each other, the holes in each column being in vertical alignment with each other.

5. The heater of claim 4, wherein:

the housing comprises four vertical sides and four vertical, diagonal surfaces, the vertical sides being connected to the diagonal surfaces at corners of the housing to define a generally-rectangular configuration for the housing; and each column of holes is located on one of the diagonal surfaces.

6. The heater of claim 1, wherein:

the housing has five columns of holes angularly spaced 72° from each other, the holes in each column being in vertical alignment with each other.

7. The heater of claim 1, further comprising:

a control system for automatically controlling the operation of the heater in response to an ambient temperature.

8. The heater of claim 1, further comprising:

a battery mounted in the housing for providing electrical power to the blower fan and heating element.

9. The heater of claim 1, further comprising:

a plurality of partitions in the housing, the partitions defining a fan compartment for enclosing the fan, a heater compartment for enclosing the heater, and a battery compartment for enclosing a battery to supply power to the fan.

10. The heater of claim 1, further comprising:

a plurality of partitions in the housing, the partitions defining an intake plenum in communication with the inlet holes and an exhaust plenum in communication with the outlet holes; and wherein the fan draws air into the intake plenum and expels air into the exhaust plenum.

11. A storage drum heater, comprising:

an elongated housing having closed ends, the housing having four vertical sides and four vertical, diagonal surfaces, the vertical sides being connected to the diagonal surfaces at corners of the housing to define a generally-rectangular configuration for the housing;

four columns of holes, each column of holes being located on one of the diagonal surfaces and having at least one inlet hole and at least one outlet hole;

a blower fan located within the housing and oriented to draw air into the housing through the inlet holes and expel air from the housing through the outlet holes;

a heating element for heating the air before prior to the air being expelled from the housing;

a control system for automatically controlling the operation of the heater in response to an ambient temperature; and a battery mounted in the housing for providing electrical power to the blower fan and heating element.

12. A transportation apparatus, comprising: a platform;

at least three storage drums arranged on the platform in an array extending radially from a central axis, inner portions of the drums defining V-shaped interstitial spaces;

a heater installed to be approximately coaxial with the central axis, and wherein the heater comprises:

an elongated housing having closed ends, the housing having an air intake and at least three outlet holes located in an exterior surface of the housing, each of the holes being aligned with one of the V-shaped interstitial spaces, the outlet holes being spaced angularly apart from each other so that each outlet hole aligns with one of the V-shaped spaces;

a blower fan located within the housing and oriented to draw air into the housing through the intake and expel air from the housing through the outlet holes into the V-shaped interstitial spaces; and a heating element for heating the air before prior to the air being expelled from the housing.

13. The apparatus of claim 12, wherein:

the intake comprises at least three inlet holes, each of the inlet holes being vertically aligned with one of the outlet holes.

14. The apparatus of claim 13, wherein:

the housing comprises four vertical sides and four vertical, diagonal surfaces, the vertical sides being connected to the diagonal surfaces at corners of the housing to define a generally-rectangular configuration for the housing;

the heater has at least four outlet holes and the intake comprises at least four inlet holes, at least one of the inlet holes and at least one of the outlet holes being located on each of the diagonal surfaces.

15. The apparatus of claim 13, further comprising:

a control system for automatically controlling the operation of the heater in response to an ambient temperature.

16. The apparatus of claim 13, further comprising:

a battery mounted in the housing for providing electrical power to the blower fan and heating element.

17. A method of maintaining a desired temperature of barrels arranged in a pattern extending radially from a central axis, inner portions of the barrels defining V-shaped interstitial spaces, the method comprising:

(a) providing a heater having an intake and exhaust holes, the heater having a blower fan and a heating element located within the heater;

(b) inserting the heater between the barrels on the central axis;

(c) drawing ambient air into the intake and heating the air; then (d) expelling the heated air out of the exhaust holes and into the interstitial spaces for warming the barrels.

18. The method of claim 17, wherein:

step (c) comprises drawing the air from below the exhaust holes.

19. The method of claim 17, wherein:

step (c) comprises drawing the air from the interstitial spaces.

* * * * *